US006085779A

United States Patent [19]

Eriksson

[11] Patent Number: 6,085,779

[45] Date of Patent: Jul. 11, 2000

[54] DRAINING GUTTER

[76] Inventor: Bertil Eriksson, Markvägen 1D, SE-890 23 Själevad, Sweden

[21] Appl. No.: 09/297,407

[22] PCT Filed: Oct. 29, 1997

[86] PCT No.: PCT/SE97/01808

§ 371 Date: Apr. 29, 1999

§ 102(e) Date: Apr. 29, 1999

[87] PCT Pub. No.: WO98/19021

PCT Pub. Date: May 7, 1998

[30] Foreign Application Priority Data

Oct. 30, 1996 [SE] Sweden ..... 9603958

[51] Int. Cl.[7] ..... F16L 5/00

[52] U.S. Cl. ..... 137/362; 137/433; 137/42

[58] Field of Search ..... 137/433, 42, 362

[56] References Cited

U.S. PATENT DOCUMENTS

| | | | |
|---|---|---|---|
| 1,009,395 | 11/1911 | Ewing | 137/362 |
| 1,109,740 | 9/1914 | Dehn | 137/362 X |
| 1,232,789 | 7/1917 | Gibson | 137/362 |
| 2,049,340 | 7/1936 | Van Der Horst et al. | 137/362 |
| 2,348,097 | 5/1944 | Smith | 137/362 |
| 3,542,057 | 11/1970 | Staiano | 137/362 |
| 4,638,829 | 1/1987 | Cornwall | 137/362 X |
| 4,936,338 | 6/1990 | Fonoimoana | 137/433 |
| 4,978,250 | 12/1990 | Dallmer | 137/362 X |
| 5,022,430 | 6/1991 | Degooyer | 137/362 |

*Primary Examiner*—A. Michael Chambers
*Assistant Examiner*—Thomas L. McShane
*Attorney, Agent, or Firm*—Zarley, McKee, Thomte, Voorhees & Sease

[57] ABSTRACT

A draining gutter, which is adapted to be placed in a floor of a space inside a building for conducting drain water away from the space through a draining conduit (3) connected thereto, has channel (15) adapted to conduct air from the space to the draining conduit upon influence of air present in the conduit away from the space. The draining gutter has also an arrangement (11, 13, 14) for adjusting the air flow resistance of the channel.

20 Claims, 3 Drawing Sheets

DRAINING GUTTER

FIELD OF THE INVENTION AND PRIOR ART

The present invention relates to a draining gutter adapted to be placed in a floor of a space inside a building for conducting drain water away from the space through a draining conduit connected thereto.

Such draining gutters are arranged in different types of sanitary spaces or rooms, such as for example bathrooms and shower-rooms, so as to receive and transport water, such as bathwater and showerwater, away. However, they may also be placed in other spaces where it is conceivable that it is desired to transport water or any other liquid resulting from for example any type of process from the space, such as any type of laboratory, work-shop premises or the like. Although water is discussed here and in the claims, this is not at all to be interpreted as limiting the invention, but there is mostly a question about water, and water is here defined as comprising all types of fluids.

In order to illuminate but not in any way restrict the invention the use of such draining gutters in bathrooms and shower premises inside buildings will be discussed hereinafter. A damp environment is formed in such draining gutters and draining conduits connected thereto, which means good conditions for the growth of bacteria, mould and fungus. Furthermore, some noxious insects thrive in the damp environment and may be reproduced very quickly there. It is in general also so that the environment as such in the room, such as for example a shower-room or a bathroom, in which the draining gutter is located has an unhealthy high humidity and results in exactly said draw-backs for people staying there as well as a risk that moisture penetrates into the frame of the building and gives rise to rot or other damaging effects.

SUMMARY OF THE INVENTION

The object of the present invention is to provide a draining gutter of the type mentioned in the introduction, which makes it possible to handle the inconveniences mentioned above and caused by the use of such draining gutters satisfying to a large extent.

This object is according to the invention obtained by providing a draining gutter according to the appendent claim 1.

Thanks to the fact that the draining gutter has said channel means for conducting air from the space to the draining conduit, it is possible to utilise the draining gutter as an exhaust air means when an arrangement transporting air, such as a fan, is arranged downstream in the draining conduit. However, such conduction of air could be achieved in any conceivable way, such as also through natural ventilation. Thus, it gets possible to obtain a ventilation of the space in question through the draining gutter, which by this gets a double function, and thanks to the conduction of air therethrough it become possible to keep the humidity level in the draining gutter as well as in the draining conduit at such a low level that the conditions for growth of bacteria, mould and fungus gets very bad and the problems connected thereto disappear. A use of the draining gutter as exhaust air means also results in a transport of the damp air present in the space away from the space through a part of the building, namely the floor, which has a water-tight isolation between the space and the building elements and the building frame located therebehind, which is an important advantage of the draining gutter according to the invention with respect to draining gutters already known, which have the consequence that the exhaust air means are arranged in walls or ceilings and by the air flows thereof transport moisture to part of the space having no water-tight isolation with respect to construction elements and the building frames located therebehind. By the fact that the draining gutter according to the invention further comprises an arrangement for adjusting the air flow resistance of said channel means it gets possible to obtain an optimum exhaust air function of the draining gutter, and to connect a plurality of such draining gutters to a draining pipe in common thereto, to which an arrangement evacuating air also in common thereto may be connected, since said adjusting arrangement enables an adjustment of the air flow resistance of the respective draining gutter according to the position the draining gutter has in the draining system, so that the draining gutter located most far downstreams in the system may be provided with the highest air flow resistance for evenly distributing the flows of air through each separate draining gutter. Furthermore, there may be particular desires of extremely large or small flows of air from any particular space, and these desires may be satisfied through the existence of the adjusting arrangement. "Adjusting" is here defined as also comprising an adjustment once and for all allowed by a draining gutter at one single location, such as in installing the draining gutter, for example by cutting off any part generating an air flow resistance to a degree suitable for the actual case.

According a preferred embodiment of the invention said arrangement is adapted to allow a repeated adjustment of the air flow resistance of the channel means. Such a construction of the draining gutter is very advantageous, since it allows a high flexibility with respect to the possibility to change the capacity of a means generating a flow of air connected to the draining conduit, connection of more draining gutters to the ventilation system or shielding draining gutters already connected thereto with respect thereto, and so on. Furthermore, an optimum adjustment of the draining gutter may take place with the time, and it is also possible to change the adjustment according to different conditions, such as seasons, degree and way of utilisation of the space or room and the like.

According to another preferred embodiment of the invention said arrangement comprises means adapted to be influenced by flows of media through the draining gutter for adjusting the air flow resistance of the channel means in dependence upon this influence. A draining gutter being self-regulated to a certain extent may in this way be provided as exhaust air means. This may for example be utilised so as to reduce the air flow resistance of the channel means upon a strong flow of water down into the draining gutter for maintaining a good air ventilation therein. But a possibility to regulate the waterflow through the draining gutter is primarily obtained, which is particularly advantageous when using the draining gutter as floor fire cock, since the water coming "the back way" may reduce the air flow resistance and by that also the resistance to the waterflow.

According to another preferred embodiment of the invention the draining gutter comprises a gutter member for receiving fluids, such as water, intended to be arranged in a hole in a floor and immersed with respect to the surrounding floor and connectable to the draining conduit, said arrangement comprises a body arranged in the gutter member for forming an obstacle against a flow of medium between an upper opening of the hole in the floor and the draining conduit therethrough, and a body is movably arranged with respect to the gutter member and adjustable with respect thereto for changing the air flow resistance of the channel means. An arrangement of such a body for adjusting the air flow resistance of the channel means is advantageous, since it enables a simple adjustment of the air flow resistance by displacing the body with respect to the gutter member.

According to another preferred embodiment of the invention the gutter member has inner walls converging downwardly, and the body is received inside the gutter member and has outer walls converging downwardly and arranged at a distance from said inner walls so as to form a passage for flow of air and fluid therebetween. For such a design of the gutter member and the body the air flow resistance of the channel means may easily be changed.

According to another preferred embodiment of the invention the draining gutter comprises a gutter member for receiving fluids, such as water, intended to be arranged in a hole in a floor and immersed with respect to the surrounding floor and connectable to the draining conduit, and it comprises means adapted to form a closing of the gutter member at the lower region thereof for collecting fluid entering the gutter member from above, and it comprises means adapted to keep the closing means preloaded in the closing position in absence of fluid collected in the gutter member and to allow opening of a connection in the lower part of the gutter member between an upper opening of the gutter member and the draining conduit besides the channel means upon reaching a predetermined level of a fluid column in the gutter member. When water is supplied above a certain level an automatic opening of the draining gutter at a lower region thereof is by this obtained, but this may be closed as soon as the column of the water collected sinks below said level, and a division of flow of air and flows of water through the draining gutter is possible by this, since substantially no flows of air will pass at the lower region of the draining gutter.

According to another preferred embodiment of the invention the draining gutter comprises members for a tight connection of fire-fighting equipment to a hole in a floor, in which the draining gutter is intended to be arranged, for enabling pumping of a fire-fighting agent, such as water, through the draining conduit and up through the gutter. The draining gutter enables by this a utilisation of the draining conduit system connected thereto for fire-fighting purposes, so that the draining conduits being often comparatively wide may be used for supply of water or other fire-fighting agents for fire-fighting. With respect to the usability of the draining gutter according to the invention in fire situations, it may be mentioned that it of course makes it possible to suck flue gases away from the space through the exhaust air means function thereof.

Further advantages as well as advantageous features of the invention appear from the following description as well as the other dependent claims.

BRIEF DESCRIPTION OF THE DRAWINGS

With reference to appended drawings, below follows a description of preferred embodiments of the invention cited as examples.

In the drawings.

DETAILED DESCRIPTION OF PREFERRED EMBODIMENTS OF THE INVENTION

Figure 1:
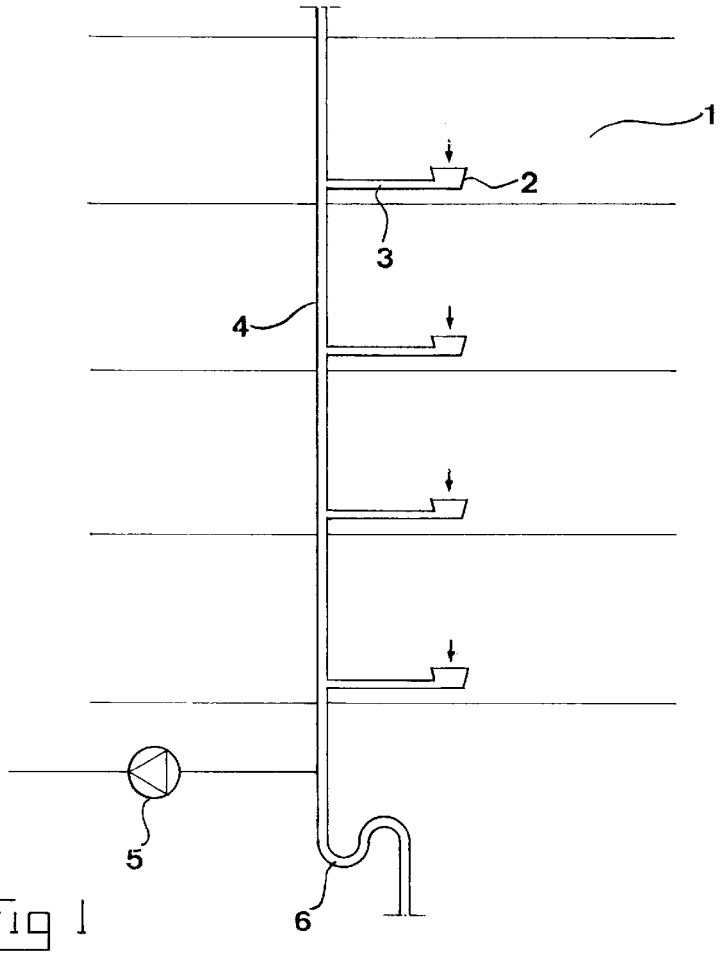
FIG. 1 is an extremely schematical representation of a part of a building provided with a draining system and draining gutters connected thereto, through which drain water is delivered to the draining system.

A part of a draining system in a building having several floors is schematically illustrated in FIG. 1, in which for the purpose of simplicity only draining gutters 2 arranged in different spaces or rooms 1 have been illustrated as units receiving water in the draining system. It is illustrated how these draining gutters are connected to a respective draining conduit 3, which in its turn is connected to a draining conduit 4 in common, to which a fan 5 is connected for generating a flow of air from the respective space through a draining gutter, the draining conduit 3, the draining conduit 4 in common and out at the exhaust side of the fan, which could be connected to the open air, but it is preferably connected to any heat exchanger for taking care of the heat contained in the air from the spaces. Preferably, other units receiving drain water, at least toilets, are in a case like this connected to another draining conduit in common than the conduit 4. Furthermore, the draining conduit 4 in common is provided with a water trap 6 for preventing odours from parts further downwardly in the draining system from reaching said spaces. The advantages of arranging draining gutters in this way as exhaust air means appear clearly from the discussion above.

Figure 2:
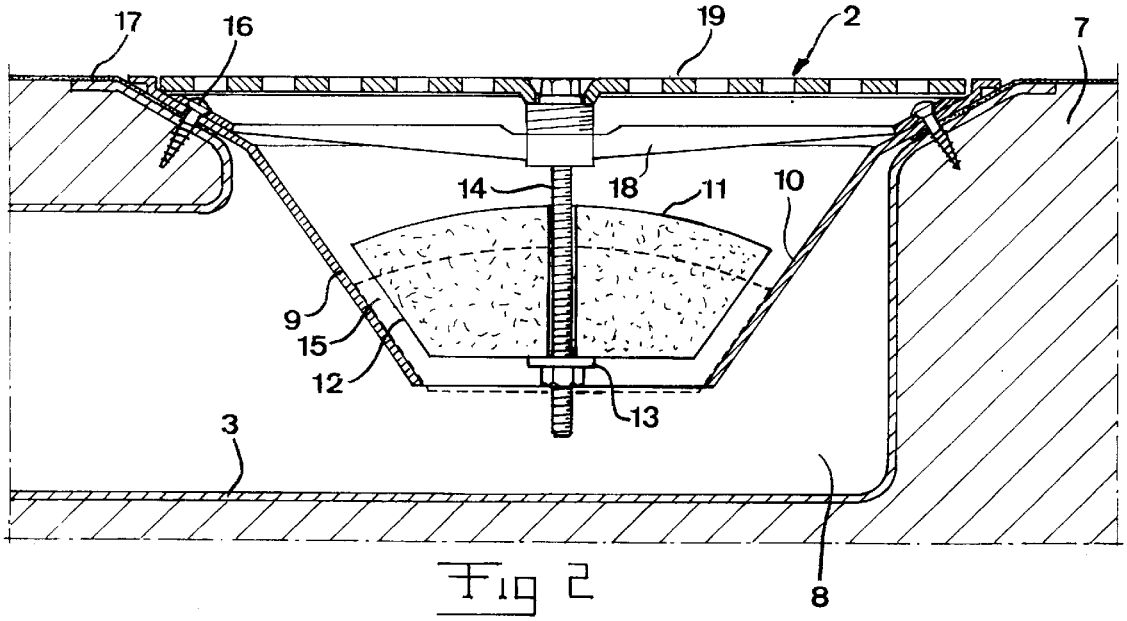
FIG. 2 is a cross section view through a draining gutter according to a first preferred embodiment of the invention.

It is shown in FIG. 2 how a draining gutter according to a first preferred embodiment of the invention looks like. The draining gutter is connected to a draining conduit 3, which emerges into a floor hole 8 arranged in the floor 7 in question, in which hole the gutter is immersed. The gutter has a gutter member 9 with inner walls 10 converging downwardly and a body 11 received therein having outer walls 12 also converging downwardly and arranged at a distance from the inner walls 10 of the gutter member so as to define a channel means therebetween for conducting air from the space over the draining gutter to a draining conduit 3. The body 11 rests freely on a lower support member 13 and is arranged movably upwardly therefrom along an axle 14 extending through the body so as to be able to be raised by water for increasing the cross-section of the channel means 15 as a float upon a very strong flow of water down into the draining gutter. Furthermore, it is possible to adjust the lowest possible level of the body 11 by screwing the support member 13 along the axle 14, which is provided with a tread. The gutter member 9 is secured in portions surrounding the floor hole by securing means 16, here screws. A floor covering 17 is preferably pressed to abut between the gutter member and portions adjacent to the floor hole. The securing means 16 are also arranged to secure a piece 18, through which the axle 14 is intended to project and be screwed with respect to so as to adjust the position of the support member 13 and by that of the body 11. Furthermore, a gutter screen or grating 19 is arranged for letting water and air sucked from the space through but trapping hair and the like. The function of this draining gutter appears from above.

Figure 3:
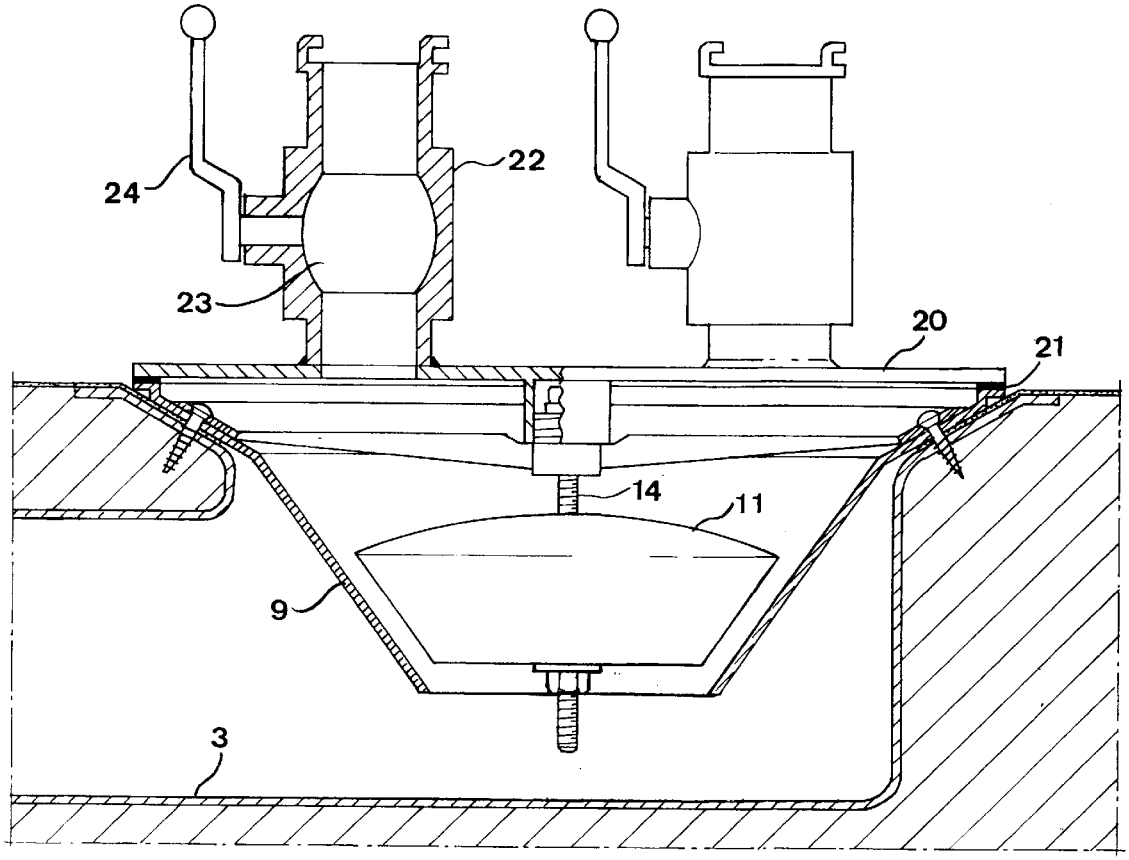
FIG. 3 is a partially sectioned view of a draining gutter according to a second preferred embodiment of the invention.

A draining gutter according to a second preferred embodiment of the invention is illustrated in FIG. 3, and this differs from the draining gutter according to FIG. 2 by the replacement of the gutter grating by a plate-like means 20, which is pressed into sealingly abutment against an upper end of the gutter member 9 through a circumfrential sealing means 21 through adjustment of the axle 14. The plate-like means has two means 22 adapted to enable a tight connection of a fire hose for enabling pumping of fire-fighting agents, such as water, through the draining conduit 3 and up through the gutter. The respective connection means is provided with a valve means 23 which may be influenced through a lever 24 for optionally closing and opening the connection between the space and the draining conduit. The intention is that it shall be possible to replace the gutter grating means 19 by the plate-like means 20 for conversion of the draining gutter into a fire cock for fire-fighting purposes. It is here particularly advantageous that the body 11 may float upwardly by the influence of water coming "the back way" in fire-fighting, so that the flow rate of the water may be increased.

Figure 4:
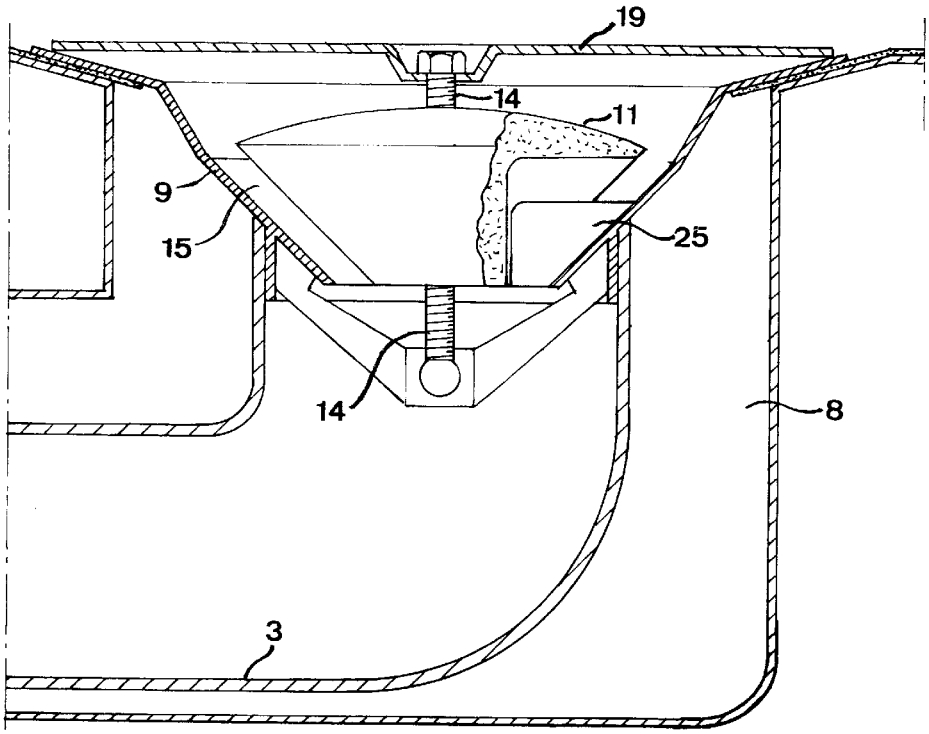
FIG. 4 is a partially sectioned view through a draining gutter according to a third preferred embodiment of the invention and, FIG. 5 is a sectioned view through a draining gutter according to a fourth preferred embodiment of the invention.

A draining gutter according to a third preferred embodiment of the invention is illustrated in FIG. 4 and has the primary difference with respect to the draining gutter according to FIG. 2 in that the body 11 is guidedly vertically displaceable along guiding means 25, and that it has an internal thread engaging the external thread of the axle 14, so that the body 11 may be vertically displaced by screwing the axle 14 for adjusting the air flow resistance of the channel means 15 defined between the body 11 and the gutter member 9 by changing the free cross-section thereof.

Figure 5:
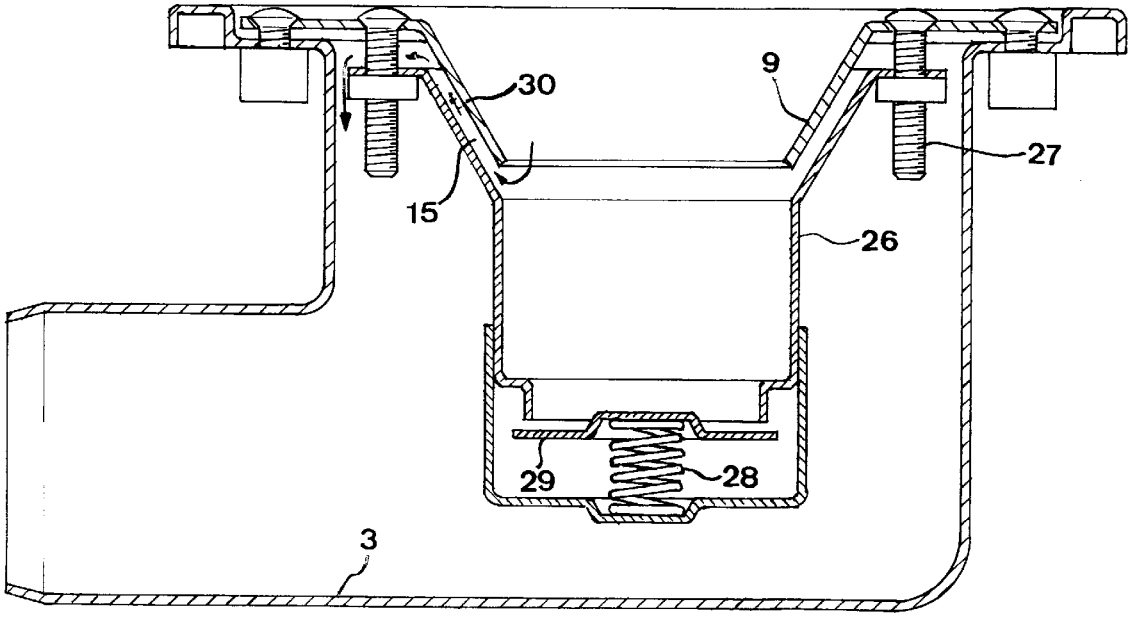

A draining gutter according to a fourth preferred embodiment of the invention is shown in FIG. 5 and has a first gutter member 9 adapted to receive water emanating from the space and a second gutter member 26 arranged at a distance outside the first one for forming the channel means 15 therebetween. The second gutter member 26 is fixed to the position with respect to the first gutter member 9 through securing means 27 and through this securing means adjustable in different positions with respect to the first gutter member for adjusting the free cross-section of the channel means 15. Furthermore, the second gutter member extends further downwardly than the first one, and the draining gutter has means in the form of a plate 29 pressed into abutment against lower edges of the second gutter member through a spring 28 and adapted to form a closing of the second gutter member at the lower region thereof for collecting water entering the gutter member from above. The spring means 28 is adapted to keep the closing means preloaded in the closing position in absence of fluid collected in the gutter member and allow opening of a connection between the lower part of the second gutter member and the draining conduit 3 when a fluid column in the gutter member reaches a predetermined level. The air streams will by this arrangement be led through the channel means 15 according to the arrows 30 separated from the water flowing down into the draining gutter. It may as an example be mentioned that the draining gutter shown in FIG. 5 may be adapted to let water through to the draining conduit upon a presence of a column of 30 mm inside the second gutter member in absence of any negative pressure in the draining conduit 3.

The invention is of course not in any way restricted to the preferred embodiments described above, but many possibilities to modifications thereof would be apparent to a man skilled in the art without departing from the basic idea of the invention.

The most different constructions of the arrangement for achieving an adjustment of the air flow resistance of the channel means are for example conceivable, and it is not quite necessary that this air flow resistance is changed by changing the cross-section of the channel means, but it is well possible to change the length of the channel means, introduce any means allowing a flow of air therethrough but increasing the air flow resistance into the channel means or the like.

What is claimed is:

1. A draining gutter adapted to be placed in a floor of a space (1) inside a building for conducting drain water away from the space through a draining conduit (3) connected thereto, characterized in channel means (15) in the gutter and adapted to conduct air from the space for ventilation thereof to the draining conduit upon influencing air present in the conduit for flow through the conduit in the direction away from the space, and an arrangement (11–14, 25–27) for adjusting the air flow resistance of said channel means.

2. A draining gutter according to claim 1, characterised in that said arrangement is adapted to allow repeated adjustment of the air flow resistance of the channel means.

3. A draining gutter according to claim 2, characterised in that said arrangement comprises means (11) adapted to be influenced by flows of media through the draining gutter for adjusting the air flow resistance of the channel means in dependence upon this influence.

4. A draining gutter according to claim 1, characterised in that said arrangement has means (25, 27) for adjusting the air flow resistance of the channel means to selectable fixed values.

5. A draining gutter according to claim 1, characterised in that said arrangement has a means (11–26) movably arranged with respect to the channel means for adjusting said air flow resistance by movement with respect to the channel means (15) so as to at least locally change the free cross-section thereof.

6. A draining gutter according to claim 1, in which it comprises a gutter member (9) for receiving fluids, such as water, intended to be arranged in a hole (8) in a floor and immersed with respect to the surrounding floor and connectable to the draining conduit (3), characterised in that said arrangement comprises a body (11) arranged in the gutter member for forming an obstacle against a flow of medium between an upper opening of the hole in the floor and the draining conduit therethrough, and that a body is movable arranged with respect to the gutter member and adjustable with respect thereto for changing the air flow resistance of the channel means (15).

7. A draining gutter according to claim 1, characterised in that the arrangement has when the gutter member is placed in a hole in a floor a means (11, 26) arranged vertically movable for adjusting the air flow resistance of the channel means (15).

8. A draining gutter according to claim 6, characterised in that the gutter member (9) has inner walls (10) converging downwardly, and that the body (11) is received inside the gutter member and has outer walls (12) converging downwardly and arranged at a distance from said inner walls so as to form a passage for flow of air and fluid therebetween.

9. A draining gutter according to claim 1, which comprises a gutter member (9) for receiving fluids, such as water, intended to be arranged in a hole (8) in a floor and immersed with respect to the surrounding floor and connectable to the draining conduit, characterised in that it comprises means (29) adapted to form a closing of the gutter member at the lower region thereof for collecting fluid entering the gutter member from above, and that it comprises means (28) adapted to keep the closing means preloaded in the closing position in absence of fluid collected in the gutter member and to allow opening of a connection in the lower part of the gutter member between an upper opening of the gutter member (9) and the draining conduit (3) besides the channel means (15) upon reaching a predetermined level of a fluid column in the gutter member.

10. A draining gutter according to claim 1, in which it comprises a gutter member (9) for receiving fluids, such as water, intended to be arranged in a hole (8) in a floor and immersed with respect to the surrounding floor and connectable to the draining conduit, characterised in that a second gutter member (26) is arranged at a distance outside the gutter member so as to form said channel means (15) therebetween, and that it comprises means (27) for displacing and adjusting the second gutter member with respect to the one first mentioned so as to adjust the free cross-section of the channel means.

11. A draining gutter according to claim 10, characterised in that the second gutter member (26) extends further downwardly than the first one, and that the closing means (28) is adapted to close the second gutter member (26) in the lower region thereof and to open a connection between the upper opening of the first gutter member (9) and the draining conduit (3) besides the channel means (15) when a fluid column in the second gutter member reaches a predetermined level.

12. A draining gutter according to claim 1, characterised in that it comprises members (20–24) for a tight connection of fire-fighting equipment to a hole in a floor, in which the draining gutter is intended to be arranged, for enabling pumping of a fire-fighting agent, such as water, through the draining conduit (3) and up through the gutter.

13. A draining gutter according to claim 12, characterised in that said members comprise a plate-like means (20) adapted to tightly seal with respect to the floor hole (8) and which has at least one connection means (22) for a fire-hose.

14. A draining gutter according to claim 13, characterised in that said connection means (22) is provided with a valve means (23), which may be influenced for optionally closing and opening a connection between said space (1) and the draining conduit (3).

15. A draining gutter adapted to be placed in a floor of a space (1) inside a building for conducting drain water away from the space through a draining conduit (3) connected thereto, comprising:

channel means (15) in the gutter and adapted to conduct air from the space for ventilation thereof to the draining conduit upon influencing air present in the conduit for flow therethrough in the direction away from the space, an arrangement (11–14, 25–27) for adjusting the air flow resistance of said channel means, a gutter member (9) for receiving fluids, such as water, intended to be arranged in a hole (8) in a floor and immersed with respect to the surrounding floor and connectable to the draining conduit, means (29) adapted to form a closing of the gutter member at the lower region thereof for collecting fluid entering the gutter member from above, and means (28) adapted to keep the closing means preloaded in the closing position in absence of fluid collected in the gutter member and to allow opening of a connection in the lower part of the gutter member between an upper opening of the gutter member (9) and the draining conduit (3) besides the channel means (15) upon reaching a predetermined level of a fluid column in the gutter member.

16. A draining gutter adapted to be placed in a floor of a space (1) inside a building for conducting drain water away from the space through a draining conduit (3) connected thereto, comprising:

channel means (15) in the gutter and adapted to conduct air from the space for ventilation thereof to the draining conduit upon influencing air present in the conduit for flow therethrough in the direction away from the space, an arrangement (11–14, 25–27) for adjusting the air flow resistance of said channel means, a gutter member (9) for receiving fluids, such as water, intended to be arranged in a hole (8) in a floor and immersed with respect to the surrounding floor and connectable to the draining conduit, a second gutter member (26) is arranged at a distance outside the gutter member so as to form said channel means (15) therebetween, means (27) for displacing and adjusting the second gutter member with respect to the one first mentioned so as to adjust the free cross-section of the channel means.

17. A draining gutter adapted to be placed in a floor of a space (1) inside a building for conducting drain water away from the space through a draining conduit (3) connected thereto, comprising:

channel means (15) in the gutter and adapted to conduct air from the space for ventilation thereof to the draining conduit upon influencing air present in the conduit for flow therethrough in the direction away from the space, an arrangement (11–14, 25–27) for adjusting the air flow resistance of said channel means, members (20–24) for a tight connection of fire-fighting equipment to a hole in a floor, in which the draining gutter is intended to be arranged, for enabling pumping of a fire-fighting agent, such as water, through the draining conduit (3) and up through the gutter.

18. A drain system for a building, comprising:

a drain in a floor of a room in the building;

a conduit connected to the drain for directing liquid away from the drain; and a fan operatively connected to the conduit for creating an air flow from the room and through the drain and conduit.

19. The drain system of claim 18 further comprising a body member adjustably mounted in the drain for adjusting the air flow through the drain and conduit.

20. The drain system of claim 19 wherein the drain and the body member define an air flow channel with an adjustable size.

* * * * *